United States Patent [19]

Mavrelis

[11] Patent Number: 4,973,276

[45] Date of Patent: Nov. 27, 1990

[54] OUTBOARD MOTOR FLUSHING APPARATUS

[76] Inventor: Peter A. Mavrelis, 5343 72nd St. N., St. Petersberg, Fla. 33709

[21] Appl. No.: 406,021

[22] Filed: Sep. 11, 1989

[51] Int. Cl.[5] ..... B08B 3/02; B08B 9/00

[52] U.S. Cl. ..... 440/113; 134/167 R; 134/199

[58] Field of Search ..... 440/88, 113, 900; 134/166 R, 167 R, 172, 199

[56] References Cited

U.S. PATENT DOCUMENTS

| | | | |
|---|---|---|---|
| 3,283,498 | 11/1966 | Connell | 440/88 |
| 3,550,612 | 12/1970 | Maxon | 440/88 |
| 3,931,828 | 1/1976 | Lawler | 440/88 X |
| 4,133,284 | 1/1979 | Holcroft | 440/88 |
| 4,246,863 | 1/1981 | Reese | 440/88 |
| 4,359,063 | 11/1982 | Carlson | 134/167 R |
| 4,619,618 | 10/1986 | Patti | 440/88 |
| 4,729,393 | 3/1988 | Ferguson | 440/88 |

*Primary Examiner*—Sherman Basinger
*Attorney, Agent, or Firm*—Leon Gilden

[57] ABSTRACT

An outboard motor flushing apparatus includes a plurality of opposed flushing heads for securement adjacent an outboard motor lower assembly for receiving fresh water therewithin through the flushing head and associated flexible conduit. The apparatus includes an elongate rigid handle formed with a planar forward terminal end surface and a clamp member overlying the end surface to secure a spring "U" shaped bracket securing the heads together to enable access to the outboard motor's lower unit from a remote orientation

2 Claims, 2 Drawing Sheets

FIG 3
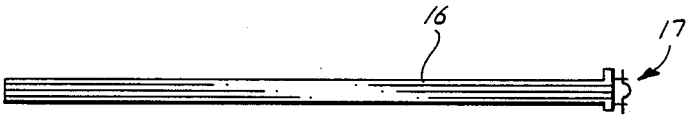
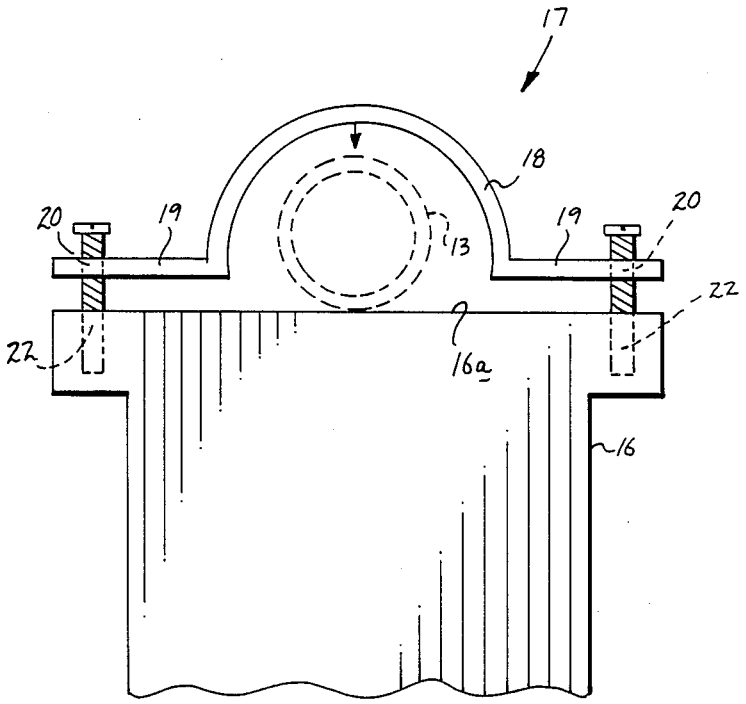
FIG 4

OUTBOARD MOTOR FLUSHING APPARATUS

BACKGROUND OF THE INVENTION

1. Field of the Invention

The field of invention relates to outboard motor flushing apparatus, and more particularly pertains to a new and improved outboard motor flushing apparatus wherein the same may be readily applied to an out-drive portion of an outboard motor from a remote orientation relative to the lower drive unit.

2. Description of the Prior Art

The prior art has set forth various organizations for the flushing of corrosive water from a drive unit of an outboard motor organization. The organizations have been necessary in use, particularly in salt water forums to purge the system of the corrosive effects of such water. Examples of the prior art include U.S. Pat. No. 4,729,393 to Ferguson wherein a threadedly releasably flush water adapter is mounted to a lower propulsion housing of an outboard motor out-drive system to enable introduction of fresh water therewithin.

U.S. Pat. No. 4,619,618 to Patti sets forth a fresh water flushing organization for use with an inboard style marine engine wherein the organization includes an inlet conduit for enabling inlet of fresh water into the engine block of the marine engine.

U.S. Pat. No. 3,550,612 to Maxon sets forth a cooling system for a marine engine for utilizing fresh water to purge the salt water therefrom provided with a novel purge valve assembly to effect such distribution of fresh water interiorly of the marine engine.

U.S. Pat. No. 3,283,498 to Connell sets forth an exhaust elbow for use in a marine engine organization, wherein the elbow is provided for handling the exhaust gas, recirculating coolant water, and coolant water discharge connections at the engine exhaust manifold of a marine engine.

U.S. Pat. No. 4,138,284 to Holcroft sets forth a marine cooling engine system utilizing various valving and conduits to effect circulation of fluid throughout the engine.

As such, it may be appreciated that there is a continuing need for a new and improved fresh water outboard motor flushing apparatus wherein the same addresses both the problems of ease of use and effectiveness in organization, and in this respect, the present invention substantially fulfills this need.

SUMMARY OF THE INVENTION

In view of the foregoing disadvantages inherent in the known types of flushing apparatus now present in the prior art, the present invention provides an outboard motor flushing apparatus wherein the same utilizes an elongate rigid handle to enable securement of flushing heads to an associated outdrive an outboard motor assembly. As such, the general purpose of the present invention, which will be described subsequently in greater detail, is to provide a new and improved outboard motor flushing apparatus which has all the advantages of the prior art marine engine flushing organizations and none of the disadvantages.

To attain this, the outboard motor flushing apparatus of the invention includes a first flexible circular head member arranged coaxially aligned in a mirror image relationship to a second circular head member arranged for overlying an input portion of an outboard drive of a marine engine assembly. The second head member includes a flexible conduit directed therewithin to direct pressurized fresh water flow through the conduit and subsequently through the second head member for directing such water into the outboard motor drive. An elongate rigid shaft includes a clamp assembly secured at a remote terminal end thereof for securement of a resilient "U" shaped bracket securing the first and second head members in a confronting relationship together to enable positioning of the first and second head members from a remote position relative to the marine outboard drive assembly.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved outboard motor flushing apparatus which has all the advantages of the prior art flushing apparatus and none of the disadvantages.

It is another object of the present invention to provide a new and improved outboard motor flushing apparatus which may be easily and efficiently manufactured and marketed.

It is a further object of the present invention to provide a new and improved outboard motor flushing apparatus which is of a durable and reliable construction.

An even further object of the present invention is to provide a new and improved outboard motor flushing apparatus which is susceptible of a low cost of manufacture with regard to both materials and labor, and which accordingly is then susceptible of low prices of sale to the consuming public, thereby making such outboard motor flushing apparatus economically available to the buying public.

Still yet another object of the present invention is to provide a new and improved outboard motor flushing apparatus which provides in the apparatuses and methods of the prior art some of the advantages thereof, while simultaneously overcoming some of the disadvantages normally associated therewith.

Still another object of the present invention is to provide a new and improved outboard motor flushing apparatus wherein the same includes an elongate rigid shaft to enable remote positioning of a flushing assembly relative to an outboard motor drive.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic top plan view of the rigid shaft and clamp assembly utilized by the instant invention.

FIG. 4 is an orthographic top plan view of the clamp assembly, somewhat expanded for illustration of detail.

DESCRIPTION OF THE PREFERRED EMBODIMENT

Figure 1:
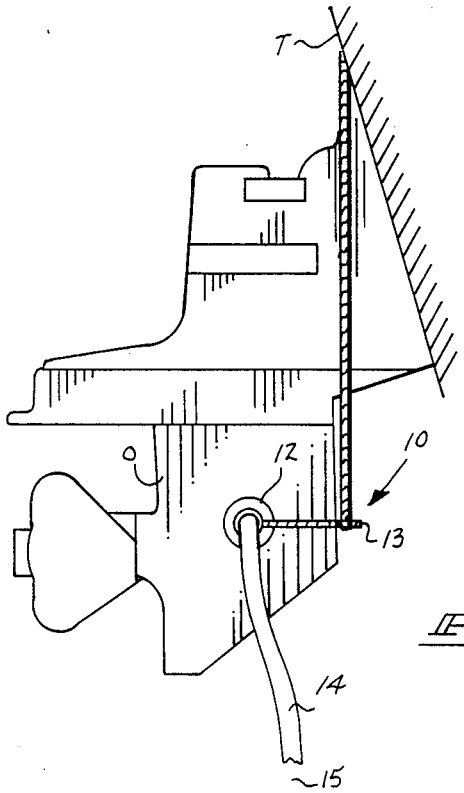
FIG. 1 is an orthographic view taken in elevation of the instant invention secured to an outboard motor assembly drive unit.
Figure 2:
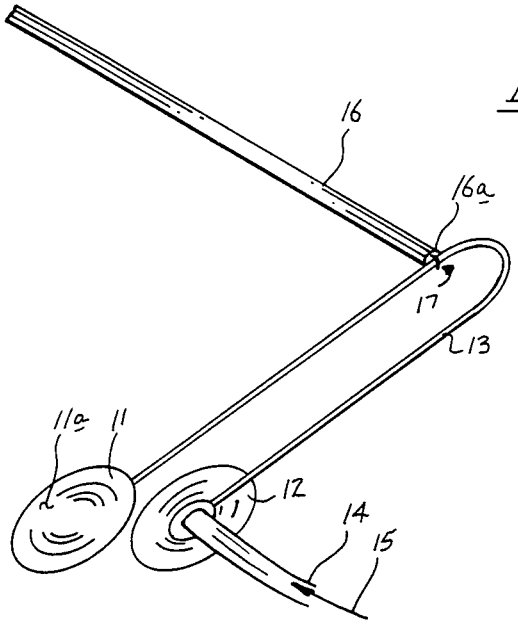
FIG. 2 is an isometric illustration of the instant invention.

With reference now to the drawings, and in particular to FIGS. 1 to 4 thereof, a new and improved outboard motor flushing apparatus embodying the principles and concepts of the present invention and generally designated by the reference numeral 10 will be described.

More specifically, the outboard flushing apparatus 10 essentially comprises a first resilient circular head member 11 formed with an internal face 11*a* coaxially aligned with a companion internal face of a second resilient head member 12 to overlie a fluid input opening portion of an outboard motor drive assembly "O". The outboard motor drive assembly is conventionally positioned extending rearwardly of a transom "T" of an associated boat. The first and second head members 11 and 12 respectively are secured in a coaxially aligned relationship utilizing a resilient "U" shaped bracket 13 normally biasing the confronting surfaces of the head members together. A flexible fluid conduit 14 is coaxially aligned with the second head member 12 to direct pressurized fresh water flow 15 through the conduit and subsequently through the second head member 12 and direct such fresh water interiorly of the outboard drive assembly "O".

An elongate, rigid shaft 16 is formed with a planar forward terminal end surface 16*a* aligned generally orthogonally relative to the elongate rigid shaft 16 and includes a clamp assembly 17 mounted thereon. FIG. 4 illustrates details of the clamp assembly, wherein a semi-cylindrical clamp member 18 includes diametrically opposed and aligned leg members 19 arranged to overlie the planar surface 16*a*. Apertures 20 are formed orthogonally through the leg members 19 to receive threaded bolt members 21 therethrough. The threaded bolt members are thereafter received within complementary threaded blind bores 22 aligned with the apertures 20 to secure the semi-cylindrical clamp member 18 and leg members 19 in a confronting relationship relative to the planar forward surface 16*a*. The semi-cylindrical clamp member 18 is defined by a radius somewhat less than that defined by the diameter or width of the resilient "U" shaped bracket 13 to enable secure clamping of the bracket 13 in an adjustable relationship relative to the clamp assembly 17.

In this manner, an individual may position himself remotely from the outboard drive assembly "O" and by positioning within the boat or from a position adjacent the outboard drive assembly "O" permitting the first and second head members 11 and 12 to be secured to the outboard drive assembly.

As to the manner of usage and operation of the instant invention, the same should be apparent from the above disclosure, and accordingly, no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An outboard motor flushing apparatus for securement to a marine engine outboard drive assembly to direct fluid therewithin, the apparatus comprising, a first head member and a second head member including a biasing means for biasing the first head member in alignment with the second head member, and a rod member secured to the biasing member, and wherein the first head member and the second head member are each formed of a circular resilient material and include internal surfaces, the internal surfaces coaxially aligned in a confronting relationship to one another, and wherein the second head member includes a flexible fluid conduit secured thereto for directing fluid through the conduit and subsequently through the second head member for directing said fluid into the outdrive assembly, and wherein the biasing means is defined by a resilint "U" shaped bracket, and wherein the rod member includes a forward terminal planar end, and a clamp assembly secured to the forward planar terminal end;

and wherein the clamp assmebly includes a semi-cylindrical clamp member and diametrically opposed and aligned leg members, the leg members including apertures directed orthogonally therethrough, and the planar end including internally threaded blind bores, and threaded bolt members directed through the apertures for reception within the blind bores to clamp the resilient "U" shaped bracket between the planar end and the semi-cylindrical clamp member.

2. An outboard motor flushing apparatus as set forth in claim 1 wherein the semi-cylindrical clamp member is defined by a radius of a predetermined length less than that of a width defined by the rod member.

* * * * *